US007431199B1

(12) United States Patent
Pettigrew et al.

(10) Patent No.: US 7,431,199 B1
(45) Date of Patent: Oct. 7, 2008

(54) GOLF FLOG

(76) Inventors: Victoria I. Pettigrew, 18640 Castle Lake Dr., Morgan Hill, CA (US) 95037; Stephen H. Pettigrew, 18640 Castle Lake Dr., Morgan Hill, CA (US) 95037

( * ) Notice: Subject to any disclaimer, the term of this patent is extended or adjusted under 35 U.S.C. 154(b) by 100 days.

(21) Appl. No.: 11/351,662

(22) Filed: Feb. 9, 2006

(51) Int. Cl.
*B68B 11/00* (2006.01)

(52) U.S. Cl. ..... 231/4; 446/421; 601/107

(58) Field of Classification Search ..... 231/2.1, 231/4; 601/107; 446/418, 421, 422; 473/138, 473/148

See application file for complete search history.

(56) References Cited

U.S. PATENT DOCUMENTS

| | | | | |
|---|---|---|---|---|
| 323,447 | A * | 8/1885 | Ruebsam | 601/107 |
| 1,915,190 | A * | 6/1933 | Koment | 601/107 |
| 4,664,375 | A * | 5/1987 | Tetreault | 473/429 |
| 5,513,842 | A * | 5/1996 | Fuss | 473/263 |
| D415,569 | S | 10/1999 | Wyrwa et al. | D24/211 |
| 6,015,086 | A * | 1/2000 | Ritchie et al. | 231/2.1 |
| 6,264,356 | B1 * | 7/2001 | Borner | 366/129 |
| 6,852,039 | B2 | 2/2005 | Pettigrew et al. | 473/280 |
| 2005/0218592 | A1 | 10/2005 | Romanchuk | 273/259 |

OTHER PUBLICATIONS

Definition of"cat-o'-nine-tails" from Dictionary.laborlawtalk.com, http://dictionary.laborlawtalk.com/cat-o'-nine-tails.
Item: Golf Flog, http://www.pintreasures.com/shop/cart.asp?.

* cited by examiner

*Primary Examiner*—Rob Swiatek
(74) *Attorney, Agent, or Firm*—Zilka-Kotab, PC

(57) ABSTRACT

A golf flog apparatus and associated method for relieving stress and/or frustration, as well as enhancing demeanor and/or play, during die play or contemplation of golf. Included is a handle with a plurality of cords coupled thereto. Further included is a plurality of golf balls each coupled to a corresponding one of the cords.

10 Claims, 1 Drawing Sheet

GOLF FLOG

FIELD OF THE INVENTION

The present invention relates to golf, and more particularly to relieving stress when playing golf.

BACKGROUND

Golf has traditionally been considered a very challenging sport. Often, players of the sport encounter situations where, despite their best efforts, a ball is shanked, a hole is missed, etc. In such situations, golf players encounter a high level of frustration and stress.

Typically, such frustration and stress are relieved by throwing a golf club or using profanity, etc. Unfortunately, these types of reactions are contrary to good golf etiquette and can lead to damaged golf equipment, damaged golf green, removal from the golf course or club, or, worse yet, injury to the golf players and/or bystanders.

There is thus a need for a solution to these and/or other problems.

SUMMARY

A golf flog apparatus and associated method are provided for relieving stress and/or frustration, as well as enhancing demeanor and/or play, during the play or contemplation of golf. Included is a handle with a plurality of cords coupled thereto. Further included is a plurality of golf balls each coupled along the length and/or to an end of one or more of the cords.

DETAILED DESCRIPTION

Figure 1:
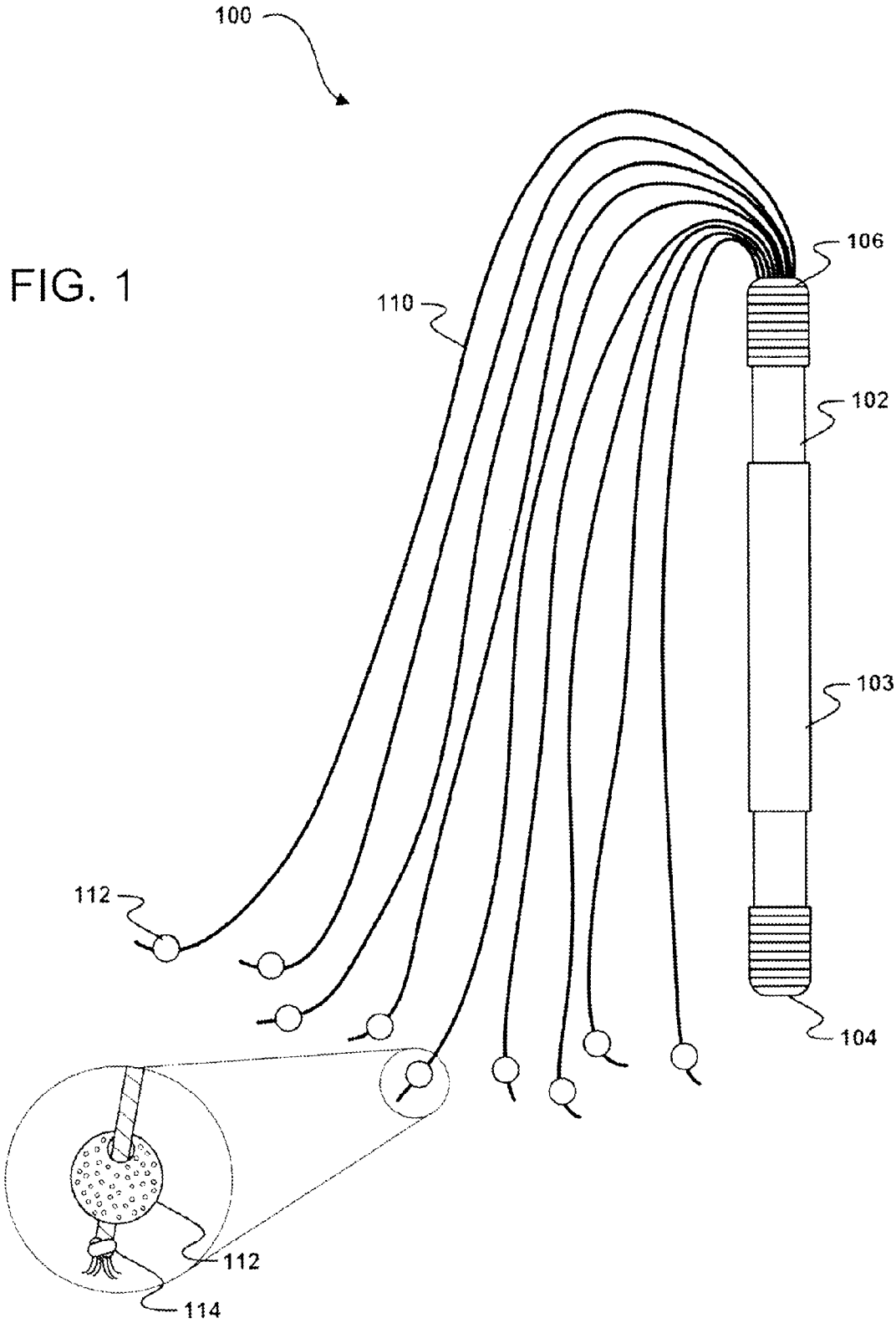
FIG. 1 illustrates a side view of a golf flog as well as a blown-up view of a terminal end of one of the strands thereof, in accordance with one embodiment.

FIG. 1 illustrates a side view of a golf flog 100 as well as a blown-up view of a terminal end of one of the strands thereof, in accordance with one embodiment. As shown, the golf flog 100 includes a rigid handle 102 with a substantially cylindrical configuration defined by a circular bottom end 104, a circular top end 106, and a cylindrical grip integrally formed therebetween.

In one embodiment, the handle 102 may be 18 inches in length. Further, in another embodiment, the handle 102 may be 1 and ½ inches in width. Of course, such dimensions are merely illustrative in nature and should not be construed as limiting in any manner whatsoever. The handle could be in the form of a conventional golf club handle used on a typical golf club (e.g. with a polymeric outer surface, etc.).

The handle 102 is shown to be manufactured from a leather material. Specifically, the handle 102 is formed of a rigid plastic or metal interior rod (not shown) which defines the cylindrical shape thereof. Further, a plurality of pieces of leather or similar material are stitched together to fit the interior rod.

Still yet, the handle 102 includes a plastic sheath 103 circumnavigating an intermediate portion of the grip. Ideally, the plastic sheath 103 is centrally located on the grip and covers about ⅓-½ of the surface area thereof. To this end, the plastic sheath 103 provides a sturdy gripping surface on the handle 102. In one embodiment, the plastic sheath 103 may be coupled to the handle 102 using at least one string that passes through one or more holes in the plastic sheath 103 while further being wrapped about the handle 102.

With continuing reference to FIG. 1, the golf flog 100 further includes a plurality of flexible cords 110. Nine of such cords 110 are provided to correlate with the number of holes typically played on a nine-hole golf course, but more or fewer cords could be provided. Each of the cords 110 further includes an inboard end coupled to the top end 106 of the handle 102 and an outboard end.

In some embodiments, each cord 110 is formed of a plurality of braided leather strands. Strictly as an option, each leather strand may be reinforced with a flexible metallic or polymeric strand situated therein. Further, as an additional option, a length of each strand may be equidistant. Further, such length may range between 100%-150% that of the handle 102. In one embodiment, each cord 110 may be 24 inches long. Of course, the cords 110 may be manufactured utilizing any desired material (e.g. fiber, plastic, etc.).

Next provided are nine rigid miniature golf balls 112 each with a spherical configuration having a dimpled outer surface, so as to mimic that of a real golf ball. Of course, various brand name indicia, etc. may be printed on the golf balls 112 to make the same more realistic. Even still, the golf balls may include instructional-related indicia such as that set forth in U.S. Pat. No. 6,852,039, which is incorporated herein by reference in its entirety for all purposes. Again, nine of such cords 110 are provided to correlate with the number of holes typically played on a nine-hole golf course, but more or fewer cords could be provided.

As shown, each golf ball 112 includes a diametrically disposed bore formed therein for receiving the outboard end of a corresponding one of the cords 110. As such, a knot 114 may be formed at an end of the corresponding cord 110 for maintaining the golf ball 112 affixed adjacent to the outboard end of the corresponding cord 110. As an option, while not shown, two knots 114 may be used, one at each diametrically opposed end of the associated golf ball 112, helping to maintain the same in stationary position with respect to the end of the associated cord 110. Golf balls could also be attached along the length of each cord.

While it is contemplated that it may be feasible to use simulated or real, full-size, functional golf balls in place of the miniature golf balls 112 (which may even be attached/detached in a way that allows the use thereof), such miniature golf balls 112, in one embodiment, are less than half or even a ¼ of the size of a real, full-size, functional golf ball (or even larger, if desired). In still further embodiments, the miniature golf balls 112 may each be formed from plastic that are blow-molded or otherwise manufactured so as to provide a lightweight hollow configuration, to prevent the chance of injury during use.

Regarding use, a golf player may choose to whip, or flog, oneself, when a ball is shanked, a hole is missed, etc. In such situations, the high level of frustration and stress of the golf player may be abated by such use. To this end, the golf flog 100 may thus be used to avoid damaged golf equipment, damaged golf green, removal from the golf course or club, or, worse yet, injury to the golf players and/or bystanders. Of course, it is contemplated that the golf flog 100 may be used without any of the above advantages and, instead, serve as a golf-related novelty for mere amusement purposes.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A golf flog apparatus, comprising:

a rigid handle with a substantially cylindrical configuration including a bottom end, a top end, and a grip formed therebetween, the handle being manufactured from a leather material, the handle further including a plastic sheath circumnavigating an intermediate portion of the grip;

nine flexible cords each including an inboard end coupled to the top end of the handle and an outboard end, each cord including a plurality of braided leather strands; and nine rigid miniature golf balls each with a substantially spherical configuration having a dimpled outer surface and a diametrically disposed bore formed therein for receiving the outboard end of a corresponding one of the cords, such that a knot at an end of the corresponding cord maintains the golf ball affixed adjacent to the outboard end of the corresponding cord.

2. The apparatus as recited in claim 1, wherein the handle is in the form of a golf club handle.

3. The apparatus as recited in claim 1, wherein a second knot formed on the corresponding cord maintains the golf ball in a stationary position with respect to the outboard end of the corresponding cord.

4. The apparatus as recited in claim 1, wherein each of the miniature golf balls is less than half of the size of a full-size functional golf ball.

5. The apparatus as recited in claim 1, wherein each of the miniature golf balls is a ¼ of the size of a full-size functional golf ball.

6. The apparatus as recited in claim 1, wherein the miniature golf balls are each formed from plastic that is blow-molded.

7. The apparatus as recited in claim 1, wherein the miniature golf balls each include a lightweight hollow configuration.

8. The apparatus as recited in claim 1, wherein each of the braided leather strands is reinforced with a flexible metallic strand.

9. The apparatus as recited in claim 1, wherein the plastic sheath is coupled to the handle using at least one string that passes through one or more holes in the plastic sheath while further being wrapped about the handle.

10. The apparatus as recited in claim 1, wherein each of the braided leather strands is reinforced with a flexible polymeric strand.

* * * * *

UNITED STATES PATENT AND TRADEMARK OFFICE

CERTIFICATE OF CORRECTION

PATENT NO. : 7,431,199 B1
APPLICATION NO. : 11/351662
DATED : October 7, 2008
INVENTOR(S) : Pettigrew et al.

It is certified that error appears in the above-identified patent and that said Letters Patent is hereby corrected as shown below:

On the Title page

In the Abstract Item (57), line 3, please replace “die” with -- the --.

Signed and Sealed this
Tenth Day of May, 2011

David J. Kappos
*Director of the United States Patent and Trademark Office*